United States Patent [19]

Nikolaus et al.

[11] Patent Number: 4,579,043

[45] Date of Patent: Apr. 1, 1986

[54] HYDROSTATIC MACHINE WITH FIXED OR VARIABLE DISPLACEMENT

[75] Inventors: Heinrich Nikolaus; Rainer Bavendiek, both of Hamburg, Fed. Rep. of Germany

[73] Assignee: Mannesmann Rexroth GmbH, Fed. Rep. of Germany

[21] Appl. No.: 661,572

[22] Filed: Oct. 16, 1984

[30] Foreign Application Priority Data

Oct. 25, 1983 [DE] Fed. Rep. of Germany ..... 3338747

[51] Int. Cl.[4] ..... F16D 11/00; F16D 13/22; F01B 13/04

[52] U.S. Cl. ..... 91/499; 192/65; 192/85 A; 192/85 AT

[58] Field of Search ..... 192/65, 85 A, 85 AT; 91/499, 507, 473

[56] References Cited

U.S. PATENT DOCUMENTS

| | | | |
|---|---|---|---|
| 652,135 | 6/1900 | Nc Nair | 192/85 A |
| 3,643,433 | 2/1972 | Widmaier | 91/473 |
| 3,721,161 | 3/1973 | Bobst | 91/499 |
| 3,808,949 | 5/1974 | Munckie | 91/473 |
| 4,224,859 | 9/1980 | Eisenmann | 91/488 |
| 4,271,725 | 6/1981 | Takao | 74/730 |
| 4,291,779 | 9/1981 | Mann | 74/391 |
| 4,382,399 | 5/1983 | Lotter | 91/499 |

FOREIGN PATENT DOCUMENTS

| | | | |
|---|---|---|---|
| 1251154 | 9/1967 | Fed. Rep. of Germany | 91/499 |
| 2522413 | 11/1976 | Fed. Rep. of Germany | 91/473 |
| 2932583 | 2/1981 | Fed. Rep. of Germany | 91/472 |
| 48104 | 4/1981 | Japan | 91/499 |
| 1010679 | 3/1963 | United Kingdom | 91/507 |

*Primary Examiner*—William L. Freeh

*Attorney, Agent, or Firm*—Harness, Dickey & Pierce

[57] ABSTRACT

A hydrostatic machine, in particular of bent axis design comprises a clutch which is provided between the drive shaft and the pistons. The force necessary for clutch engagement is produced by hydraulic pressure forces which are either applied to the pistons or delivered by the pistons depending on whether the machine operates as a motor or as a pump. When the machine neither produces a moment nor receives a moment the clutch is automatically disengaged due to the reduction of the hydraulic pressure forces. According to the invention the clutch helps to prevent hydraulic losses of the machine while running idle and improves the overall efficiency.

11 Claims, 4 Drawing Figures

HYDROSTATIC MACHINE WITH FIXED OR VARIABLE DISPLACEMENT

BACKGROUND OF THE INVENTION

When operating a hydrostatic machine under idle conditions with no external load applied, the pistons of the machine reciprocating in the cylinder bores cause substantial hydraulic losses which decrease the efficiency of the machine.

It is therefore highly desirable to provide a hydrostatic machine of a known type with a clutch for separating the machine from the mechanical drive system to avoid hydraulic losses in running idle and to improve the efficiency.

Prior to the present invention, clutches and/or brakes have been added to axial piston machines. For example, an axial piston machine is provided with a spring-operated multiple-disc brake (design Rexroth) to act on the drive shaft of vehicles and hoisting equipment. Furthermore, a conical friction brake mounted to the drive shaft of an axial piston machine (design Molly) is known to reduce the speed of the machine to zero.

SUMMARY OF THE INVENTION

According to the invention there is provided a hydrostatic machine with fixed or variable displacement, comprising a drive shaft and a plurality of pistons, wherein the hydraulic pressure forces applied to said pistons or, respectively delivered by said pistons are in balance with a moment trasmitted through said drive shaft, the improvement comprising a clutch which is provided between said drive shaft and said pistons which clutch is operated by said hydraulic pressure forces in response to said moment.

According to the invention, the clutch is actuated by using the hydraulic pressure forces produced by the machine as a control to automatically engage and disengage the clutch in response to the moment. While running idle any rotation of the machine is prevented by automatically disengaging the clutch to avoid volumetric and hydro-mechanical losses occurring with conventional machines while running idle. However, as soon as hydraulic pressure forces become active in the machine depending on whether the machine operates as a motor or as a pump, the pressure forces automatically cause the clutch to come into engagement. Since the clutch forces correspond to the hydraulic pressure forces, the total torque moment of the machine can be transmitted through the clutch.

According to the invention, the clutch operates mechanically to automatically interrupt the flow of force in the driving or driven system. Depending on the load condition of the machine rotation is transmitted or stopped since the force transmission is controlled in response to the moment or, respectively in response to the pressure prevailing in the pressure line of the system:

Basically the invention can be applied to axial piston machines of the swash plate design, wherein the swash plate is stationary and the cylinder drum is connected to the drive shaft, as well as to machines of bent axis design, wherein the swash plate is connected to the drive shaft. In either case the hydraulic pressure forces generated by the pistons must act on a first clutch member, whereas the second clutch member is connected to the drive shaft. The invention can be relatively easy applied to machines of the bent axis design in which the swash plate is rotatably arranged and connected to the drive shaft (claims 2 and 3).

Further improvements are obtained by the present invention. Accordingly, a force can be produced to support the disengagement of the clutch (claims 4 to 8).

According to a further improvement of the invention, means are provided to guide the clutch members with respect to each other in the disengaged condition (claims 9 and 10).

The invention further provides for a system enabling the clutch of the hydraulic machine operating as a motor or as a pump to be engaged and to be released at full operating pressure and further to change from pump operation to motor operation and vice versa. Accordingly the clutch can be actuated even under full operating pressure while wearing the clutch is avoided when actuated under load.

Additional advantages and benefits of the present invention will become apparent upon reading of the description of a preferred embodiment taken in conjunction with the accompanying drawing.

DETAILED DESCRIPTION

Figure 1:
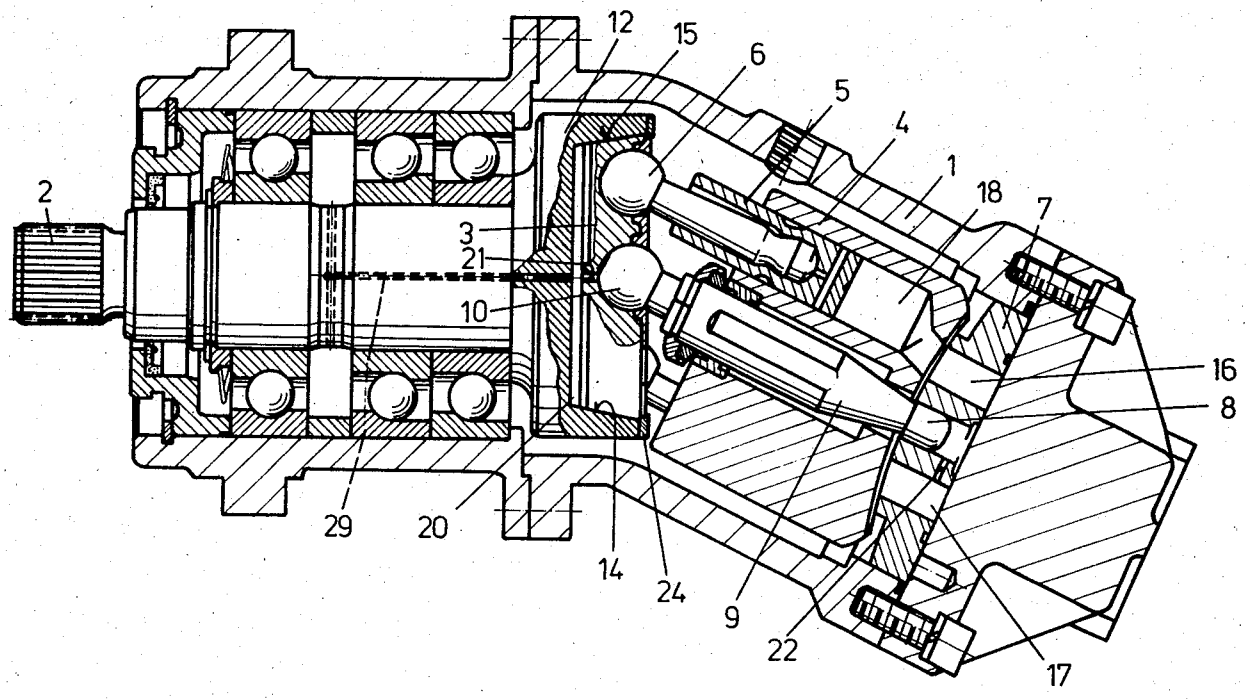
FIG. 1 is a sectional view of an axial piston machine of the bent axis type including a clutch.

As shown in FIG. 1, a stationary casing 1 houses a drive shaft 2, a swash plate 3, a cylinder drum 4 including a number of pistons 5, ball shaped rods 6 and a control plate 7. The cylinder 4 and the pistons 5 are provided under an angle with respect to the axis of the drive shaft (bent axis design). The swash plate 3 and the rotary cylinder 4 rotate together due to the pivotal joint provided for by the ball shaped rods 6 and the swash plate 3.

The rotary cylinder 4 is rotatably supported on a center bolt 8 which extension 9 includes a ball shaped head 10 which is centrically received in the swash plate 3.

The swash plate 3 is shaped to be a first clutch member which defines a conical friction clutch in cooperation with a second clutch member 12 which is integrally provided at the drive shaft 2. The clutch member 3 is provided with a conical outer surface 14 engaging an internal conical surface 15 of the shaft member 12.

Figure 4:
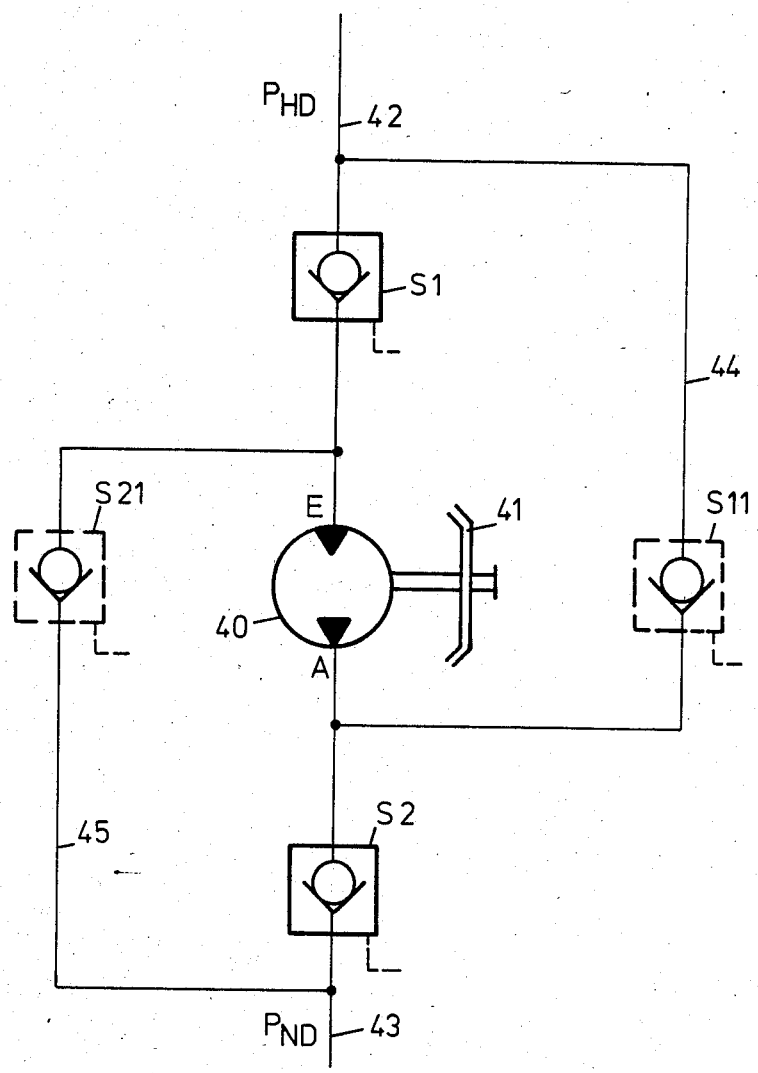
FIG. 4 is a schematic illustration showing the connections of an axial piston machine to a high pressure and low pressure line.

The valve control plate 7 includes a pair of kidney-shaped slots 16 and 17 to be connected each to a high pressure and low pressure line as shown in FIG. 4.

Operating as a motor, a pump not shown supplies pressure medium through the inlet slot 16 to the cylinder bores 18, the pressure acting on the pistons 7 to rotate the swash plate 3 producing a torque corresponding to the pressure difference at the inlet and outlet port of the machine.

The force necessary for engaging the clutch members 3 and 12 is produced by the hydraulic forces acting on the pistons 5. When there is no operating pressure in the inlet port 16, there are no reactive forces producing the clutch engaging pressure and the clutch is disengaged to interrupt the driving connection between the clutch member 3 and the shaft 2.

However, when pressure is produced in the cylinder bores 18 by a pump for example, the pressure acts through the pistons 5 and piston rods 6 on the clutch member 3 which is urged onto the conical surface 15 of the clutch member 12 to engage the clutch for driving connection. The torque delivered by the machine can be thus transmitted from the swash plate 3 to the drive shaft 2.

A clutch chamber 20 is provided between the clutch members 3 and 12 which chamber communicates through a central bore 21 in the member 3 and a channel not shown in the ball head 10, the extension 9 and the center bolt 8 with a bore 22 in the valve control plate 7 which bore 22 opens into the control port 17 which is connected to the low pressure line. Accordingly the clutch chamber 20 is vented to low pressure.

When the pressure in the high pressure decreases, for example, when a variable displacement pump feeding into the high pressure line is returned to zero stroke position, the low pressure prevailing in the clutch chamber 20 supports the disengaging movement of the clutch member 3. It is seen that the low pressure acts on the relatively large cross sectional area of the member 3 which is thus urged from its conical seat on the member 12 towards a ring 24 mounted on the member 12 at the end of the conical surface 14.

Figure 2:
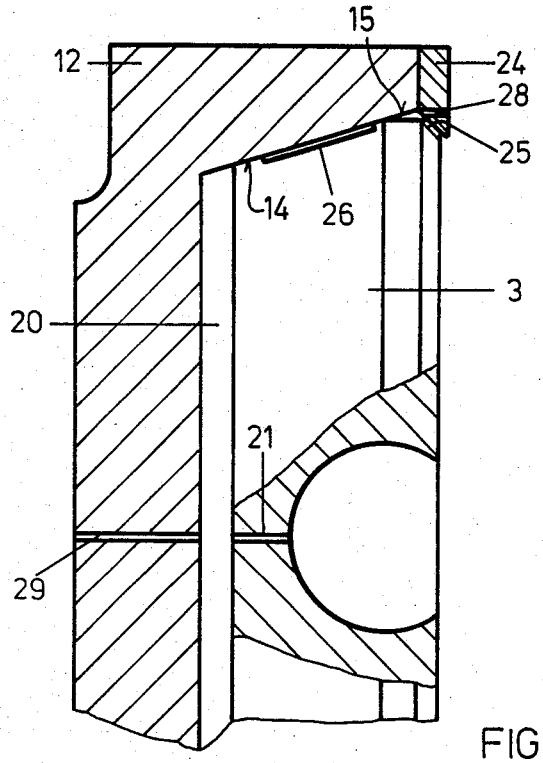
FIG. 2 is a magnified fragmentary sectional view of the clutch.

Details are shown in FIG. 2 depicting a fragmentary section of the clutch in larger scale. Corresponding to the conical face of the ring 24 the adjacent portion 25 of the member 3 is chamferred. Thus a gap is provided between the ring 24 and the chamferred portion 25 of the member 3 when the clutch is disengaged to allow liquid to flow out from the clutch chamber 20. The outer surface of the member 3 is provided with grooves 26 to facilitate the outflow of liquid from the chamber 20 into the gap. Accordingly the ring 24 and the member 3 define a hydrodynamic bearing to rotatably support the member 3 within the member 12 when the clutch is disengaged. It is apparent that the member 3 comes to a complete stop, whereas the shaft and the member 12 may be rotated by a drag force when the shaft is driven by the wheel of a vehicle, for example.

A bore 28 is further provided in the ring 24 to allow liquid to flow from the chamber 20 to the pressure-free spaces of the machine when the clutch is disengaged to release unnecessarily high forces from the axial bearings.

To determine the conical angle of the friction clutch, it should be observed that the cone must be not self-locking and that a slippage of the clutch must be avoided. When the angle is selected too small, the clutch will be self-locking. When the angle is selected too large the torque produced by the machine can be not transmitted and the clutch slips. Substantially the angle of the cone depends on the geometrical dimensions of the machine, the torque delivered and the angle of the rotary cylinder with respect to the axis of the shaft.

A further bore 29 communicating with the chamber 20 is provided in the member 12 and the shaft 2 to supply liquid from the chamber 20 to the bearings.

For exerting a predetermined disengagement force to the clutch member 3, a spring not shown may be arranged between both members 3 and 12. Additionally, the spring may disengage the clutch, when no hydraulic disengaging force can be produced because of failure in the low pressure line, for example.

Figure 3:
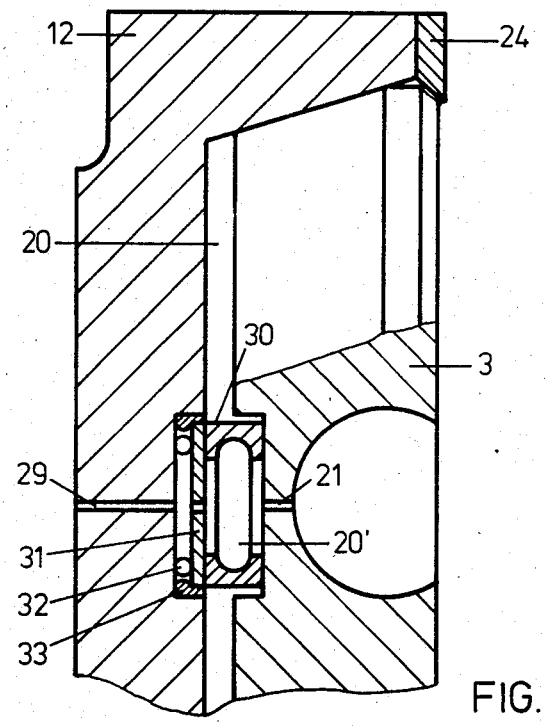
FIG. 3 is a magnified fragmentary sectional view of a further embodiment of the clutch.

FIG. 3 shows an alternate embodiment of the clutch according to which the loss of liquid flowing from the chamber through the clutch gap and the bore 28 can be avoided. As shown in FIG. 3, a flat diaphragma cylinder 30 in the shape of a resiliently collapsible ring is mounted between the clutch members 3 and 12 which cylinder separates the space 20' in which low pressure prevails from the chamber 20. The cylinder is sealingly seated on the member 3 as well as on the plate 31 of an axial bearing 32 which is sealed off from the chamber 20 by a seal 33. Accordingly low pressure only acts on the partial area of the member 3 which is determined by the space 20'.

FIG. 4 shows a hydraulic machine including a clutch 41 according to the invention, which inlet port E is connected through a pilot-operated check valve S1 to a line 42 of high pressure $p_{HD}$ and which outlet port is connected through a pilot-operated check valve S2 to a line 43 of low pressure $p_{ND}$. A bypass line 44 including a check valve S11 which opens towards the line 42 connects the outlet port A of the machine 40 to the high pressure line 42. The inlet port E of the machine is connected to the low pressure line 43 by a bypass line 45 including a check valve S21 which opens towards the inlet port E. Like the pilot-operated check valves S1 and S2 the check valves S11 and S21 can be pilot-operated as indicated in broken lines when the machine is desired to run in both rotational directions.

The pilot operated check valves S1, S2, S11 and S21 may be of the type shown in U.S. Pat. No. 3,381,581, entitled "Hydraulic Control System", issued May 7, 1968.

The system shown in FIG. 4 allows the hydrostatic machine 40, preferably of fixed throughput, to be connected to and disconnected from a load not shown while operating as a motor or being driven and further allowing the machine to change from operating as a motor to operating as a pump and vice versa. The system is particularly advantageous as a hydrostatic drive system for a vehicle.

To operate the hydraulic machine, the following operational cycles are specified:

I. Engaging the clutch and operating the machine as a motor

S1 closed and S2 open, no flow through the machine

S2 is closed, machine 40 is connected through S21 to low pressure line 43 delivering leakage liquid which flows out from machine 40, machine stops, clutch 41 is disengaged

S1 is opened after a time delay, whereupon clutch 41 is engaged. A torque cannot be produced since inlet and outlet port of the machine are connected to high pressure, the machine is accelerated to the shaft speed without delivering a torque, wherein fluid returns through bypass line 44 and S11

S2 is opened after a time delay, fluid flows from line 42 through S1 and the machine and S2 to the low pressure line 43. The machine delivers torque and operates as a motor II. Disengaging the clutch and terminating motor operation As under item I, S1 and S2 are open

S1 is closed, clutch 41 is disengaged, fluid can circulate through S21 until the machine stops S1 is closed after a time delay, the machine stops and is connected through S21 and bypass line 45 to the low pressure line 43 for compensating leakage oil.

III. Shifting from motor to pump operation (from driving a load to the condition of driving the machine by the load)

While operating as a motor both valves S1 and S2 are open

S2 is closed, high pressure is supplied to the inlet port and outlet port, the clutch 41 is engaged; since the machine produces no pressure difference, the torque goes to zero. As the machine is driven from the vehicle, liquid circulates through S1, the machine 40, bypass line 44 and S11

S1 is closed, machine 40 delivers liquid from low pressure line 43 through bypass line 45 and inlet port E through outlet port A, bypass line 44 and S11 to the high pressure line 42, thus closing S1 results in producing a brake torque, machine 40 operating as a pump.

IV. Shifting from pump to motor operation

S1 and S2 are closed as indicated under item III

S1 is opened, as inlet and outlet port of machine 40 are supplied by high pressure through S11, no load torque can be produced S2 is opened, liquid circulates through S1 and the machine 40 and S2 from the high pressure line to the low pressure line, the machine operates as motor.

V. Engaging the clutch and operating as a pump (coasting operation)

S1 closed, then closing S2, machine 40 stops, clutch 41 is still disengaged

S1 is opened, clutch 41 is engaged, machine 40 is accelerated to the speed of the drive shaft without producing torque, wherein liquid circulates from high pressure line 42 through bypass line 44 and S11

S1 is subsequently closed, machine delivers liquid from the low pressure line 43 through S21 to the high pressure line 42 through S11.

The system shown makes it possible after engaging the clutch to accelerate the machine from standstill to any speed of the drive shaft without delivering or, respectively receiving torque. Condition for this operation is the pilot-operated check valve S2. In this way, an undue wear of the clutch is prevented.

To adapt the system according to FIG. 4 for the reversed direction of rotation of the machine 40, both check valves S21 and S11 must be pilot-operated to allow for a reversed flow of liquid. The operations above referred to can be then repeated for the reversed direction, for example to reverse the motion of a vehicle.

What is claimed is:

1. A hydrostatic machine comprising a plurality of pistons, a swash plate supported for rotation about an axis and engaged by said piston, and a drive shaft rotatable about said axis, wherein the hydraulic pressure forces of said pistons are in balance with a torque on said drive shaft, characterized in that a clutch means is provided between said drive shaft and said swash plate, said clutch means comprising a first conical surface on said swash plate and a cooperative second conical surface on said drive shaft, said clutch means being actuated by said hydraulic pressure forces in response to said torque.

2. A hydrostatic machine as set forth in claim 1 wherein the axial piston machine is of the bent axis design.

3. The hydrostatic machine of claim 1, wherein the space between the front faces of said swash plate and the drive shaft is connected to a low pressure line to produce a disengaging force acting on the swash plate to support the disengaging motion of said clutch means when the high pressure is released.

4. The hydrostatic machine of claim 3, wherein the space is connected through a bore in the swash plate and in a center bolt to the low pressure port of the valve control plate of said machine.

5. The hydrostatic machine of claim 3, wherein the clutch space is vented through a throttle bore in the disengaged position of said clutch means.

6. The hydrostatic machine of claim 3, wherein the low pressure clutch space is defined by a compressible cylinder element which is sealingly provided between said swash plate and said drive shaft.

7. The hydrostatic machine of claim 6 wherein said cylinder element is supported on said drive shaft through an axial bearing.

8. The hydrostatic machine of claim 1, wherein the swash plate is guided by means of an axial bearing with respect to the clutch member provided on said drive shaft when the clutch means is released.

9. The hydrostatic machine of claim 8, wherein the axial bearing is a hydrodynamic bearing providing an annular gap between the swash plate and the shaft member when the clutch is released through which annular gap fluid is released from the clutch space.

10. The hydrostatic machine of claim 1, wherein the inlet port and the outlet port of the machine each is connected via a pilot-operated valve to a high pressure line and to a low pressure line and wherein between the high pressure line and the low pressure line and the inlet port and the outlet port of the machine each is provided a valve which opens in the direction of flow from the inlet to the outlet and closes when the flow direction is reversed.

11. The hydrostatic machine of claim 10, wherein the valves each are pilot operated check valves to operate said machine in both directions of rotation.

* * * * *